US007517308B2

(12) United States Patent
Stentenbach

(10) Patent No.: US 7,517,308 B2
(45) Date of Patent: Apr. 14, 2009

(54) DEVICE FOR LAYING WEB MATERIAL

(75) Inventor: Udo Stentenbach, Nordhorn (DE)

(73) Assignee: Rosink GmbH + Co. KG Maschinenfabrik, Nordhorn (DE)

( * ) Notice: Subject to any disclaimer, the term of this patent is extended or adjusted under 35 U.S.C. 154(b) by 0 days.

(21) Appl. No.: 11/681,231

(22) Filed: Mar. 2, 2007

(65) Prior Publication Data

US 2007/0207908 A1 Sep. 6, 2007

(30) Foreign Application Priority Data

Mar. 4, 2006 (DE) ..... 10 2006 010 069

(51) Int. Cl.
*B31F 1/00* (2006.01)
*B31B 1/32* (2006.01)

(52) U.S. Cl. ..... 493/433; 493/411; 270/39.01; 270/39.05

(58) Field of Classification Search ..... 493/411–414, 493/433; 270/39.01, 39.05, 39.06
See application file for complete search history.

(56) References Cited

U.S. PATENT DOCUMENTS

| | | | | |
|---|---|---|---|---|
| 4,846,454 | A * | 7/1989 | Parkander | 270/5.02 |
| 4,871,157 | A * | 10/1989 | Hermann et al. | 270/39.02 |
| 4,908,010 | A * | 3/1990 | Yoshioka | 493/357 |
| 5,062,597 | A * | 11/1991 | Martin et al. | 270/39.02 |
| 5,064,179 | A * | 11/1991 | Martin | 270/39.02 |
| 6,209,288 | B1 | 4/2001 | Rahn et al. | |
| 2008/0070772 | A1 * | 3/2008 | Mizuno et al. | 493/442 |

FOREIGN PATENT DOCUMENTS

| | | |
|---|---|---|
| DE | 98806 | 8/1898 |
| DE | 100658 | 12/1898 |
| DE | 116670 | 1/1901 |
| JP | 49069995 | 7/1974 |
| JP | 55080650 | 6/1980 |
| JP | 9132352 | 5/1997 |
| SU | 798013 | 1/1981 |

* cited by examiner

*Primary Examiner*—Hemant M Desai
(74) *Attorney, Agent, or Firm*—Gudrun E. Huckett

(57) ABSTRACT

A device for laying continuously supplied web material in zigzag lengths has a pendulous arm positioned within a supply path of the web material and a holding-down device pushing down the web material at least in the area of the reversal points of the zigzag length. By arranging the holding-down device on the pendulous arm, a particularly a simple construction of such a laying device is provided.

22 Claims, 6 Drawing Sheets

Fig. 5
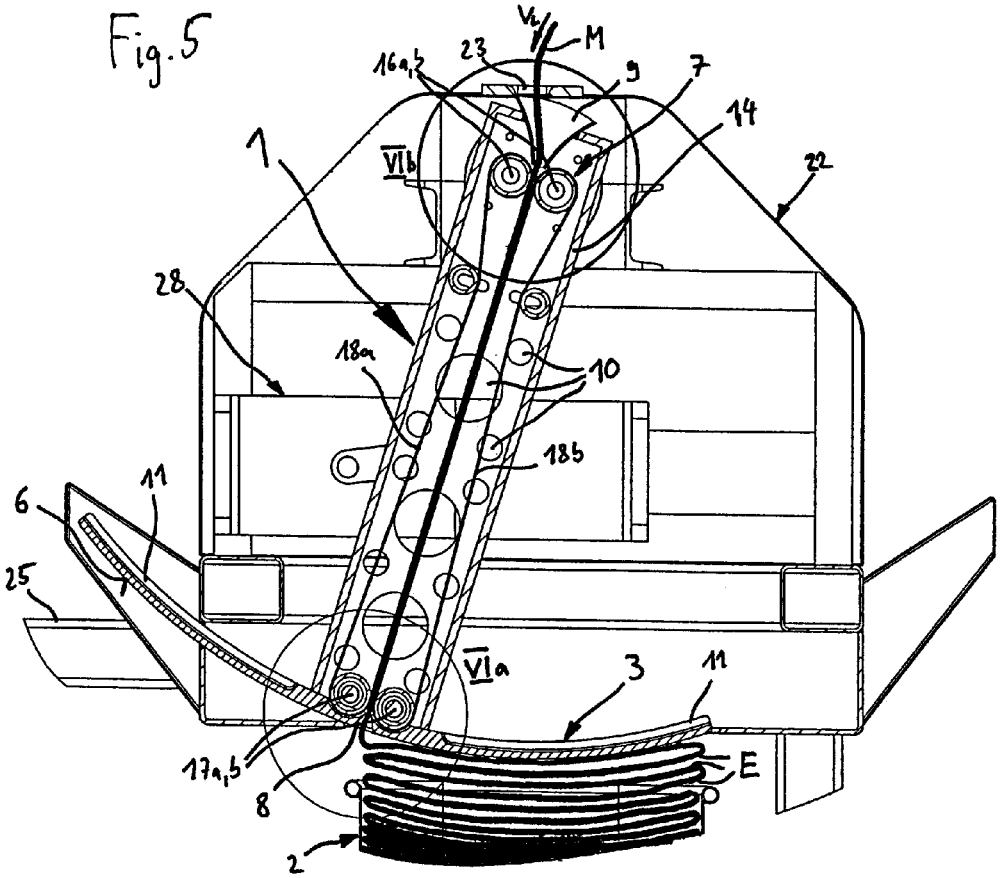
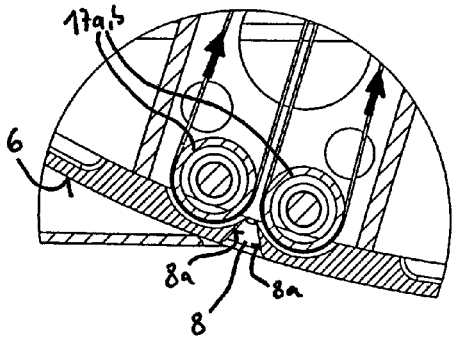
Fig. 6a
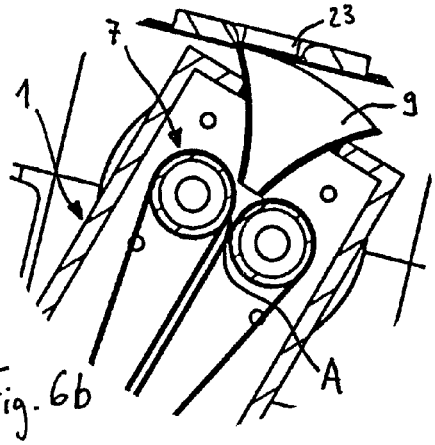
Fig. 6b

DEVICE FOR LAYING WEB MATERIAL

BACKGROUND OF THE INVENTION

The present invention concerns a device for laying continuously supplied web material in zigzag lengths, the device comprising a pendulous arm located within the supply path and a holding-down device for pushing down the web material at least in the area of the reversal points of the zigzag lengths.

The manufacture of web material, for example, made from fabric, nonwoven, paper material etc., is frequently realized in a continuous process. The continuously produced web material is laid subsequent to manufacture in zigzag lengths in several stacked planes or layers in a receiving and transport container. U.S. Pat. No. 6,209,288 B1 discloses a device in which the placement of continuously supplied web material is realized by means of a pendulous arm that is arranged in the supply path of the web material. The pendulous arm swings back and forth between two end positions wherein a receiving container is movable underneath the pendulous arm transversely to its pendulum movement so that a continuous placement of the web material in the form of zigzag lengths results.

When placing the web material in zigzag lengths, especially the reversal loops resulting in the area of the reversal points between the individual lengths have proven to be disadvantageous. The reversal loops have the tendency to produce bulges projecting relative to the other layer sections; these bulges disrupt the placement of additional zigzag lengths and limit the achievable degree of filling of the receiving and transport containers. In order to keep these bulges as small as possible, in the device described in U.S. Pat. No. 6,209,288 B1, two pneumatically operating holding-down devices are provided. After the pendulous arm has placed the web material underneath the holding-down device, the latter is lowered for a short period of time onto the last laid reversal loop and compresses it so that the height of the bulges is reduced and higher degrees of filling of the receiving containers can be achieved.

A disadvantage of such holding-down devices is the correlated great apparatus expenditure and the complex mutual coordination in regard to the pendulum motion of the pendulous arm.

It is therefore an object of the invention to provide a device of the aforementioned kind that is characterized in particular by its simple construction.

SUMMARY OF THE INVENTION

This object is solved for a device of the aforementioned kind in that the holding-down device is arranged on the pendulous arm.

By arranging the holding-down device directly on the pendulous arm, there results a simple construction of the device. Additional, for example, pneumatically operating, holding-down devices whose movement must be coordinated with regard to the pendulous motion of the pendulous arm are not required.

An advantage of such a construction of the device is an embodiment in which the pendulous arm is pivotably supported on a pendulum axis that is substantially horizontal and the holding-down device is arranged at the end of the pendulous arm facing away from the pendulum axis.

Moreover, it is suggested that the holding-down device has a circular arc-shaped surface that glides across the web material of the last laid zigzag length. By means of this gliding action, undesirable bulges of the material web in the area of the reversal points of the zigzag length are pressed down so that the zigzag lengths can be stacked in a space-saving way in several layers on top one another so that high degrees of filling of the receiving and transport containers can be achieved.

For a controlled placement of the supplied web material it is advantageous when the circular arc-shaped area has a friction-reduced surface. Such a surface can be generated, for example, by polishing, by coating or similar means. The transmission of transverse forces onto the upper material length is avoided.

A weight-reduced embodiment that thus keeps the inertia of masses of the pendulous arm at a minimum provides that the holding-down device has a substantially ring segment-shaped cross-section. The bottom side of the ring segment serves as a gliding surface for the last material length.

Another contribution to weight reduction is made by providing at least one cutout at the rear of the holding-down device.

Advantageously, the pendulous arm is provided with a web conveyor by means of which the web material is conveyed from the upper end of the pendulous arm in the direction toward an exit opening in the holding-down device through which exit opening the web material exits from the pendulous arm. With such a web conveyor, the web material can be conveyed uniformly across the entire length of the pendulous arm and through the exit opening of the holding-down device.

A further embodiment provides that at least one lower deflection roller is a component of the web conveyor, that the area of the holding-down device extends to a point underneath the deflection roller, that an upwardly extending wall adjoins the area, and that the wall extends up to a level above the bottom side of the deflection roller. As a result of the partial extension of the circular arc-shaped area to a point underneath the web conveyor or its lower deflection roller, impairments of the already laid uppermost zigzag length by means of the deflection roller or the conveying belt passing across it are avoided. The upwardly extending wall improves the exiting action of the web material leaving the pendulous arm.

Advantageous is a configuration in which the wall together with a symmetric oppositely arranged wall forms an upwardly tapering cross-section of the opening. As a whole, an opening that in cross-section is funnel-shaped results with which, in particular, a reproducible placement of the web material at the reversal points is achieved.

Advantageously, at the upper end of the pendulous arm there is a funnel provided through which the web material is supplied to the web conveyor in order to achieve in this way a uniform supply of the web material that is independent of the pendulum position of the pendulous arm.

With regards to the pendulum properties of the pendulous arm or for reducing weight it is furthermore proposed that the pendulous arm is provided with openings. By providing such openings, the weight of the pendulous arm that is already made of light-weight material, for example, aluminum, is further reduced.

A further advantageous embodiment provides that the drive for the pendulous arm is realized by means of a linear motor. By employing linear motors, the pendulum speed of the pendulous arm can be approximated to a rectangle function with negligibly small reversal times in the end positions of the pendulum movement.

A further advantageous embodiment of the invention provides as a placement and transport container a can in which the zigzag arrangement of the web material can be laid in several stacked layers. Such cans are primarily known in the field of textile technology and are suitable for receiving large amounts of web lengths.

Advantageously, such a can has a substantially rectangular base area wherein the zigzag lengths extend between the two long sides of the can. In this way, the pendulum travel of the pendulous arm swinging between the two long sides of the can is kept short.

A further embodiment of the invention provides that the can has a spring plate for laying the zigzag lengths; the spring plate can be lowered against the force of a spring into the interior of the can so that a further constructive simplification of the device results. A readjustment with regard to height of the pendulous arm or of the can in accordance with the height of the laid zigzag lengths is not required. The height compensation is automatically achieved by means of the spring plate that is compressed or is lowered downwardly in accordance with the amount of laid web material.

When in accordance with a further embodiment the can is movable underneath the pendulous arm by drive means in the direction of the pendulum axis, it is possible to achieve in a simple way deposition of the web material in the form of zigzag lengths. By means of the traveling speed of the can, it is furthermore possible to affect the shape of the zigzag lengths.

For realizing a simple zigzag placement, it is advantageous to have a configuration in which the can is movable in the direction of its long side.

A further advantageous configuration provides for a substructure in which two cans are movable. By means of the substructure in which the two cans are movable, it is possible to exchange a completely filled can for the next still empty can without interruptions of the supply of web material, for example, in that both cans pass behind one another underneath the pendulous arm. Downtimes and the resulting costs are thus prevented. It can also be advantageous to provide more than two movable cans. For example, while the first can is being filled, the second can is arranged in the changing position behind the first one while at the same time a third can is being moved into the substructure.

The present invention concerns moreover a method for laying web material within a rectangular area in zigzag lengths in several stacked layers.

In known web laying methods, placement of the web material is realized by layering the zigzag lengths in several stacked layers or planes. The reversal points of the zigzag lengths, i.e., the locations of the zigzag lengths where the web material is subjected to a change in direction, are problematic and an upwardly bulging spatially obstructive loop is formed. With increasing number of layers and the action of the holding-down device, the bulges of the loops are reduced to a fold but even such folds require more storage volume than the remaining sections of the zigzag lengths.

It is therefore an object of the present invention to provide a method of the aforementioned kind that enables a compact laying of the web material.

As a solution, in regard to a method of the aforementioned kind it is proposed that at least one reversal point of a newly laid layer is located farther inwardly relative to the rectangular area in comparison to the reversal point of the layer that is arranged directly underneath.

In this way, it is possible to arrange the reversal points or the material folds located thereat of one layer relative to the next layer in a displaced arrangement such that several folds are not positioned vertically above one another; this provides a compact layering in combination with a higher degree of filling of the employed storage or transport containers.

A configuration is advantageous in which the reversal points of the zigzag lengths of one layer are arranged in a common reversal row so that within one plane uniform pendulum end positions of the pendulous arm are provided from one zigzag length to the next.

A further advantageous embodiment provides that the two reversal rows of a newly laid layer are displaced laterally by a spacing relative to those of a plane arranged directly underneath so that a congruent positioning of the reversal points of these planes is avoided.

For a compact layering of the web material in several stacked layers, it is moreover advantageous when in one layer two reversal points that are located farther inwardly follow two reversal points that are flush with the rectangular area and that the reversal points flush with the rectangular area of the subsequent layer are arranged above the farther inwardly positioned reversal points of the plane underneath.

It is finally advantageous when the arrangement of two layers is repeated periodically after two layers, respectively.

BRIEF DESCRIPTION OF THE DRAWINGS

Further details of the device according to the invention and of the method according to the invention will be explained in the following with the aid of the attached drawings.

FIG. 5 is a section illustration of a pendulous arm embodied according to the invention and of a housing surrounding it.

FIG. 6*a* is an enlarged detail illustration of the detail identified at VIa in FIG. 5.

FIG. 6*b* is an enlarged detail illustration of the detail identified at VIb in FIG. 5.

DESCRIPTION OF PREFERRED EMBODIMENTS

Figure 1:
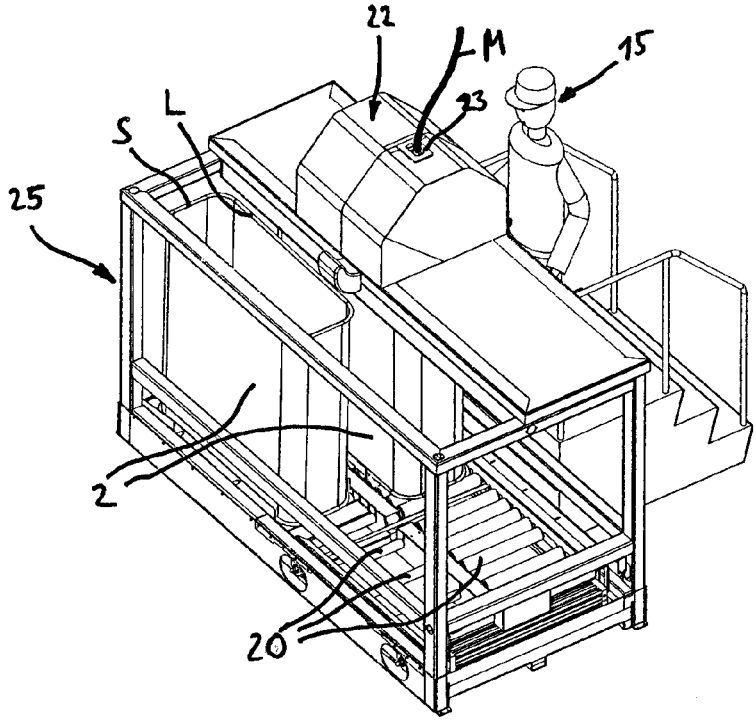
FIG. 1 is a perspective illustration of a device according to the invention with a substructure for receiving several cans.

A device for laying continuously supplied web material M in zigzag lengths is illustrated in a perspective overview illustration in FIG. 1. Essentially, the device is comprised of a substructure 25, two rectangular cans 2, and a pendulous arm covered by housing 22 in FIG. 1 and arranged above the cans 2. The rectangular cans 2 have essentially a rectangular base area with a long side L and a short side S and are slidably received in a plane that is comprised of a plurality of rolls 20. For this purpose, underneath the cans 2 drive means for the rolls 20 are provided by means of which the cans 2 can be moved reciprocatingly at a defined speed underneath the pendulous arm in the direction toward the long sides L.

Figure 2:
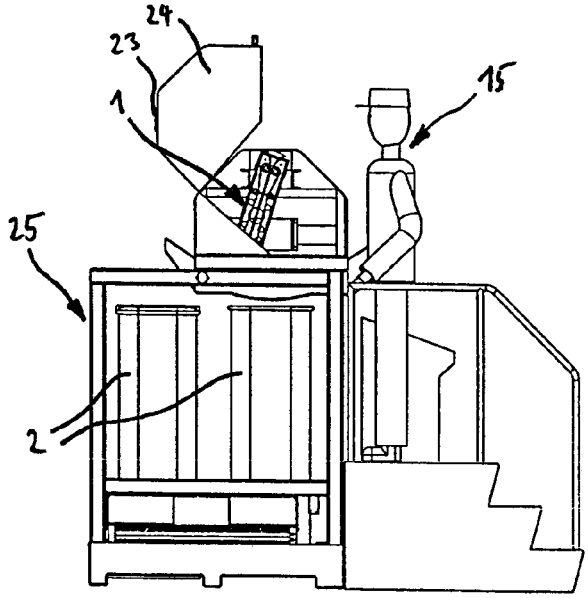
FIG. 2 is a side view of the device of FIG. 1.
Figure 3:
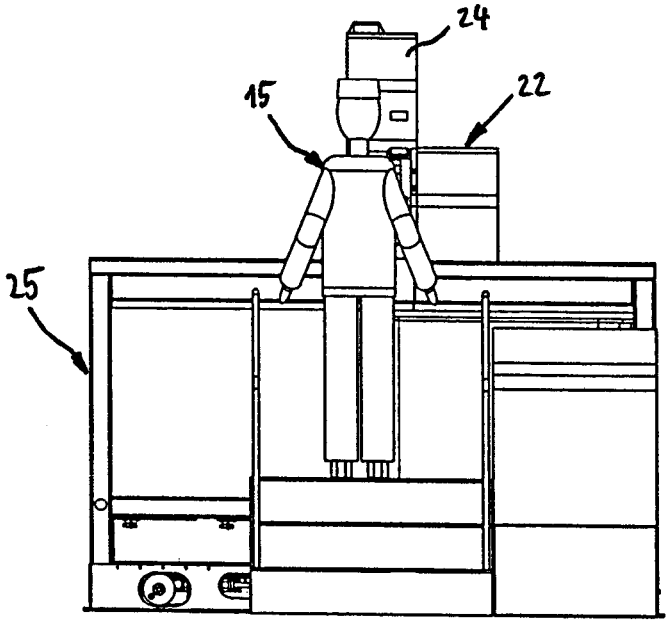
FIG. 3 is a front end view of the device of FIG. 1.
Figure 4:
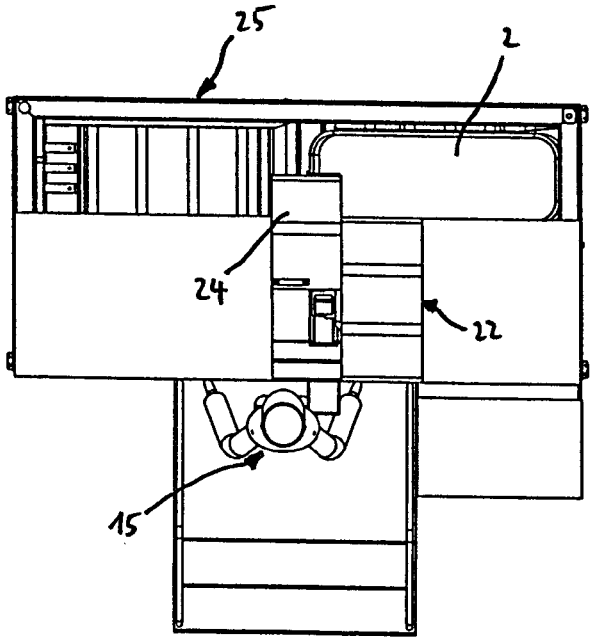
FIG. 4 is a plan view onto the device of FIG. 1.

The size of the substructure 25, as shown in FIGS. 2 through 4, is dimensioned such that two cans 2 can be moved adjacent to one and behind one another. In the illustrated embodiment, the right can 2 of FIG. 1 is filled with web material M, i.e., is moved back and forth underneath the pendulous arm 1 that is positioned in the supply path of the web material M and is illustrated in FIG. 2. Shortly before the can 2 is completely filled, the second can 2 is moved into the changing position behind the filled can 2 and both are moved, with their short sides S resting against one another, to pass underneath the pendulous arm 1. While the filled can 2 is moved out of the substructure 25, filling of the next can 2 is realized without interruptions of the web supply. In this way, downtimes of the laying device are avoided so that, for example, web storage devices for intermediate storage of the web material M that is continuously supplied by the web-producing machines is not required. The substructure 25 illustrated in the embodiment is sized such that when the second can 2 is moved into the changing position behind the first can 2, a third can 2 can already enter the device.

Figure 8:
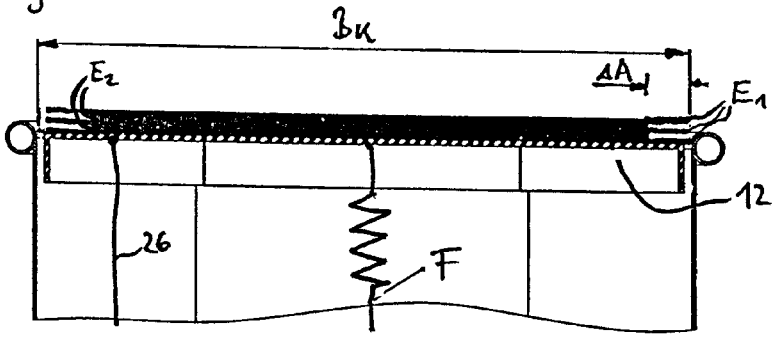
FIG. 8 is a section illustration in accordance with the section line identified at VIII-VIII in FIG. 7.

The cans 2 that are used in the illustrated embodiment are rectangular cans 2 as they are widely used in textile technology; they have, for example, a height of 1,270 mm, a width of 410 mm, and a length of 1,190 mm and are suitable for receiving a comparatively large amount of web lengths. The cans 2 have a rectangular base area. Within the cans 2, as shown, for example, in the section illustration of FIG. 8, a spring plate 12 serving as a laying plane can be lowered in the vertical direction. By means of spring F, the spring plate 12 of a still unfilled can 2 is secured in a position near its upper opening. With the increase of laid web material M, the spring F is compressed so that the laying plane 12 is lowered into the interior of the can.

The force of the spring F can be matched to the specific weight of the web material M in such a way that the height readjustment between pendulous arm 1 and the laying surface is automatically realized by means of the weight of the web material M, i.e., laying of the zigzag lengths 4 is done always approximately at the level of the opening of the can 2. Also, the force of the spring F can be such that the weight of the laid web material M is not quite sufficient for compression of the spring F. In this case, the excess portion of the spring force F forces the layers E of the zigzag lengths 4 permanently from below against a holding-down device 3 arranged on the pendulous arm 1 (compare FIG. 5) so that a compression of the laid web material will result. When the spring plate 12 has reached its lower end position in the can 2, the further placement of the web material M leads to a further compression with an increase of the friction between holding-down device 3 and the upper layer E.

In the FIGS. 2 through 4, the lid 24 of the housing 22 surrounding the pendulous arm 1 has been opened by the operator 15 for servicing and installation work. For threading the web material M through a housing opening 23 designed like a feed hopper into the pendulous arm 1 at the beginning of the laying process, opening of the lid 24 is not required. For this purpose, the web material M must only be introduced from the exterior into the feed hopper-shaped housing opening 23 where it is engaged by a web conveyor, to be described in the following, and moved downwardly.

Details and the function of the pendulous arm 1 will be explained in the following with the aid of FIGS. 5, 6*a*, and 6*b*.

The pendulous arm 1 is pivotably supported within the housing 22 at the topside of the substructure 25. The continuous supply of the web material M coming from an upstream carder is realized from above by means of a supply device, not illustrated in the Figures, through the feed hopper-shaped supply opening 23 provided in the housing 22.

The pendulous arm 1 is pivotably supported within the housing 22 on a pendulum axis A that extends substantially horizontally. The pendulum axis A in the illustrated embodiment is located approximately centrally between the axis of rotation of the drive rollers 16*a*, 16*b* of the twin web conveyor 7; see FIG. 6*b*. The pendulous arm 1 is driven by a linear motor 28. Such linear motors 28 are distinguished, despite their comparatively minimal mass, by having great power, so that short reversal times of the pendulous arm 1 in the pendulum end positions can be achieved so that the pendulum speed of the pendulous arm 1 is approximated to a rectangle function.

The pendulous arm 1 in a side view (FIG. 5) has an anchor shape. It is comprised of a shaft 4 that in cross-section has a U-shape; in the illustrated embodiment, two web conveyors 7 are arranged on the shaft and a holding-down device 3 is arranged at the lower end of the shaft 14. The web conveyor 7 is comprised of leading rollers 17*a*, 17*b* and rearward rollers 16*a*, 16*b* that are provided at the upper end of the pendulous arm 1, are driven and coupled by means of a belt 18*a* or 18*b* to the leading rollers 17*a*, 17*b*. The oppositely positioned roller pairs 16*a*, 16*b* and 17*a*, 17*b* run at the same speed and move in opposite rotational directions so that the conveyor belts 18*a*, 18*b* are moved in the direction indicated by the two arrows in FIG. 6*a* and entrain the web material M that is schematically shown in FIG. 5 across the length of the shaft 14.

At the lower end of the U-shaped shaft 14, i.e., at the end of the pendulous arm 1 facing away from the pendulum axis A, a circular ring segment-shaped holding-down device 3 is arranged that has at its bottom side a circular arc-shaped surface 6 whose radius of curvature corresponds to the spacing to the pivot axis A. The circular arc-shaped surface 6 is symmetric to the pendulous arm 1 and is made to be especially friction-reduced, for example, by polishing or by coating. At the center of the holding-down device 3, a funnel-shaped opening 8 is provided through which the web material M moved downwardly through the pendulous arm 1 exits the pendulous arm 1 and is laid in several layers E into the can 2. Below the holding-down device 3, the transport and storage container is illustrated in the form of a can 2 which, in the direction of the pendulum axis A, is moved back and forth underneath the pendulous arm 1 from one short side S to the opposite short side S so that a placement of the web material M in the form of horizontal zigzag lengths 4 results (compare FIG. 7). By means of the travel speed of the can 2 it is possible to affect the zigzag lengths 4. For example, the angles between the individual horizontal zigzag lengths increase with increasing speed of the can 2 while they decrease with slower speed, i.e., the zigzag lengths 4 are laid closer together. Advantageously, the traveling speed of the can 2 is matched such to the width $B_B$ of the web material that the zigzag lengths 4 are positioned closely packed adjacent to one another laterally.

As can be seen also in the illustration of FIG. 5, the individual layers E across the length of the can 2 have a curvature that matches the radius of the surface 6 across which they are pressed against the force of the spring F of the spring plate 12 into the can 2.

The web material M is supplied continuously at a web supply speed $V_L$ to the device by means of a supply system directly from a web-producing machine, for example, a carder or carding machine etc. Laying the web material M is realized at the same speed.

The web material M passes from above through a housing opening 23 into the device. Below the housing opening 23 the pendulous arm 1 swivels back and forth above the opening of the can 2 between its long sides L. The end of the pendulous arm 1 facing the housing opening 23 is provided with an intake funnel 9 whose slanted funnel surfaces in all pendulum positions of the pendulous arm 1 enable a uniform passing of the web material M into the device. In the supply direction of the web material, the twin web conveyor 7 adjoins the funnel 9 and transports the web material M across the length of the shaft 14. At the lower end of the pendulous arm 1 the web material M finally exits in the area of the holding-down device 3 through an opening 8 the pendulous arm 1 that swings transversely across the rectangular can 2 and is laid in several layers E in zigzag lengths into the can 2. For weight reduction and thus for improving the pendulum properties of the pendulous arm 1, it is made of lightweight material, for example, aluminum. Moreover, in the shaft 14 a plurality of openings 10 are provided. The holding-down device 3 has also cutouts 11 at the rear also for the purpose of weight reduction.

The pendulous arm 1 swings at such a frequency, that in the area of its circular surface 6 a traveling speed is adjusted that is approximately identical to the speed $V_L$ of the supplied web material M. While the pendulous arm 1 is pivoted from the left into the right pendulum position, web material M is being supplied whose length is approximately matching the width of the can 2. Details in this regard will be explained in more detail in the following with the aid of FIGS. 7 to 11.

The web material M exits from the pendulous arm 1 first in the direction of its shaft 14, i.e., essentially perpendicularly to the surface 6 of the holding-dawn device 3. Subsequently, the web material M meets the uppermost zigzag length 4 that has been laid underneath the holding-down device 3 and is subjected by means of the pendulum movement of the pendulous arm 1 to a directional change from one side of the can 2 to the opposite one and is laid flat onto the preceding zigzag length 4. In this way, the zigzag lengths are layered in several layers E in the vertical direction.

In FIG. 5, the left pendulum end position of the pendulous arm 1 is illustrated in which the web material M forms a reversal loop that, depending on the material properties of the web material as well as its thickness, will bulge more or less upwardly; this can cause problems with regard to further laying of the web material M in the next plane E. In order to keep these bulges as minimal as possible, at the lower end of the pendulous arm 1 the holding-down device 3 is mounted and swivels together with it. As the pendulous arm 1 swivels, it glides along the uppermost zigzag length 4 and forces it at the same time, in particular at the reversing point 5, downwardly so that the bulges are reduced and a better degree of filling of the cans 2 can be achieved. For this purpose, the holding-down device 3 is provided at its surface 6 with especially friction-reducing means in order to avoid displacement of already laid zigzag lengths 4 by the action of transverse forces. In particular, the forces that are exerted on the zigzag lengths 4 by the holding-down device 3 transversely to the pendulum movement are smaller than the friction-caused securing forces of the vertical layers E relative to one another.

In the illustrated embodiment, the force of the spring F of the spring plate 12 is sized such that the layers E are subjected to a clamping force between the holding-down device 3 and the spring plate 12 so that a compact laying of the layers E is realized. The layers E are curved downwardly at the center of the can 2 in accordance with the radius of the smooth surface 6; this has no negative effect on the degree of filling of the can because the reversal points near the edges of the can 2 require more volume than the remaining sections of the zigzag lengths 4 anyway. At the beginning of the laying process, the spring plate 12 is secured first, for example, by a wire 26 (compare FIG. 8) in a position near the opening of the can 2 so that it is not pressed against the holding-down device 3 and does not damaged the friction-reduced surface 6. Clamping of the layers E is realized only once the spacing between the upper position of the spring plate 12 and the holding-down device 3 is filled with web material M.

The holding-down device 3 extends with its surface 6 to a point underneath the twin web conveyor 7. The leading (lower) reversing rollers 17*a*, 17*b* of the web conveyor in this way are separated by the smooth surface 6 of the holding-down device 3 from the laid zigzag lengths 4. The opening 8 provided at the center of the holding-down device 3 has two walls 8*a* that are symmetrically positioned opposite one another and extend upwardly to a point between the rollers 17*a*, 17*b*. The opening 8 as a result of the slanted walls 8*a* is in cross-section funnel-shaped so that a defined reversal of the web material M at the reversal point 5 of the zigzag lengths 4 is achieved. The reversal loops that are produced in the area of the reversal points 5 are compressed or ironed flat from above by the holding down-device 3 so that a flat and thus space-saving layering of the zigzag lengths 4 results.

FIG. 5 indicates schematically the tendency that the bulges in the area of the reversal points 5 will become flat with increasing height of the laid stack or the number of layers E of the vertically stacked zigzag lengths 4; however, within the zigzag lengths 4 that are deeper down within the can 2, there remain material folds that also have a greater height so that the circular arc shape of the planes E does not present any disadvantage.

A laying method that, despite the fold formation still increases the achievable degree of filling, will be described in the following with the aid of FIGS. 7 through 11. The rectangular area serving as a laying support is formed in the following examples primarily by the rectangular spring plate 12.

Figure 7:
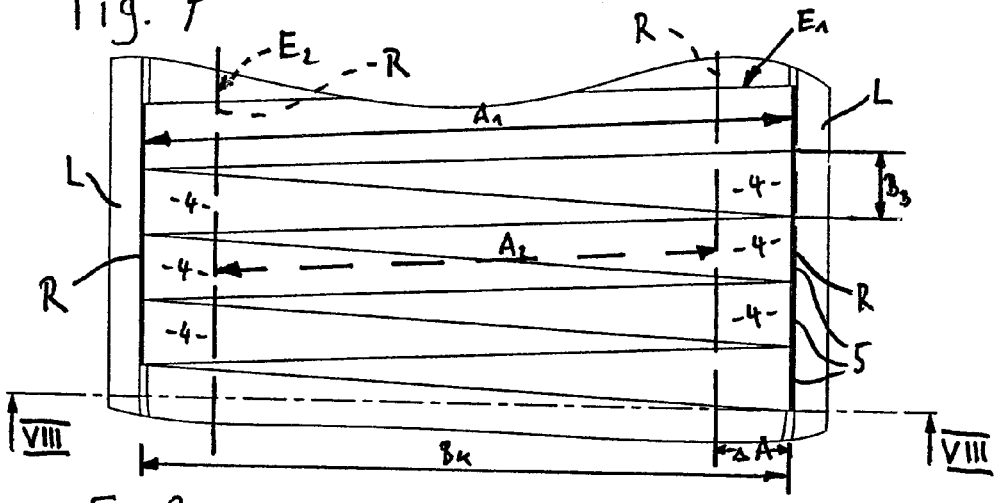
FIG. 7 is a plan view onto zigzag lengths laid into a can.

FIG. 7 shows a plan view onto a rectangular can 2 between whose long sides L a plurality of zigzag lengths 4 extend in several vertically stacked layers E. The reversal points 5 of the zigzag lengths 4 arranged in the area of the left and right longitudinal sides L of the can 2 are arranged, viewed in the longitudinal direction of the can 2, so as to be aligned in common reversal rows R.

In the upper layer $E_1$ all zigzag lengths 4 have a length $A_1$ that matches approximately the width $B_K$ of the can 2 or of the spring plate 12 so that the reversal rows R are positioned approximately flush with the long sides L of the can 2.

The zigzag lengths 4 of the next higher plane $E_2$ that are indicated by means of the their reversing rows R in dashed lines in FIG. 7 have a length $A_2$ that is shorter than the length $A_1$ so that the plane $E_2$ is smaller than the rectangular area of the spring plate 12. The reversal points 5 or the reversal rows R have in this plane $E_2$ a spacing $\Delta A$ to the long sides L of the can 2 or to the reversal rows R of the plane $E_1$ positioned underneath. In this way, there results a vertical displacement of the reversal points 5 from one plane to the next so that several reversal points 5 or folding locations are not positioned above one another, compare FIG. 8.

In this way, not only a compact layering of the zigzag lengths 4 is achieved but also the folds between the zigzag lengths 4 will not become so sharp or pointed. Folds that are too sharp are undesirable for a plurality of future processing steps of the web material M serving as a starting material. In order to achieve such layering of zigzag lengths 4, the pendulum travel of the pendulous arm 1 is decreased or increased alternatingly when moving form one plane E to the next, i.e., for a directional reversing action of the can 2 moving underneath the pendulum arm 1, so that alternatingly planes E with larger lengths $A_1$ or shorter length $A_2$ result. A schematic illustration of the principle of the alternating displacement of the reversal points 5 or of the reversal rows R by the spacing ΔA, respectively, from one layer E to the next is illustrated in FIG. 13*b* in a view from the side.

Figure 9:
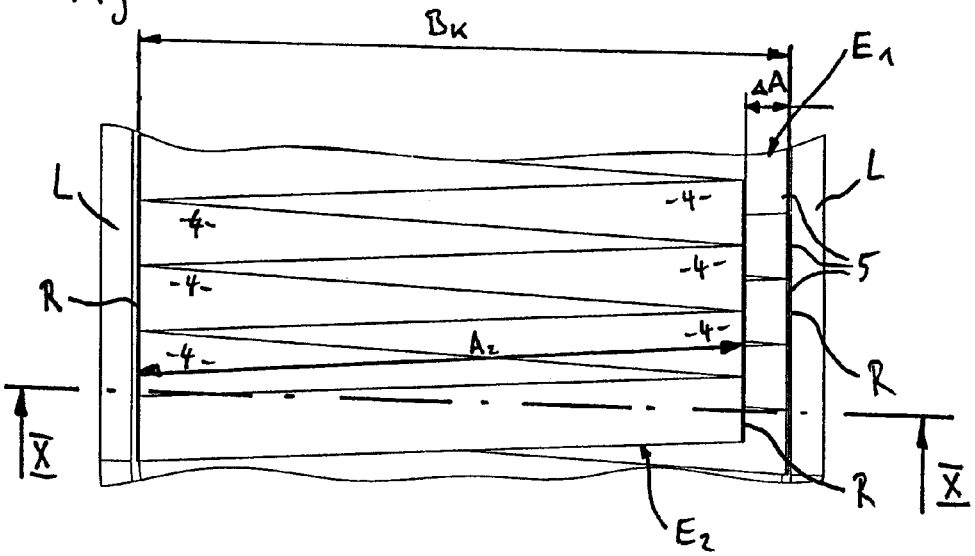
FIG. 9 is a further plan view onto zigzag lengths laid into a can.
Figure 10:
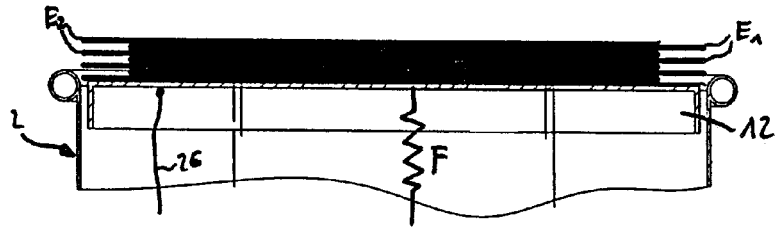
FIG. 10 is a section illustration in accordance with the section line identified at X-X in FIG. 9.
Figure 13A:
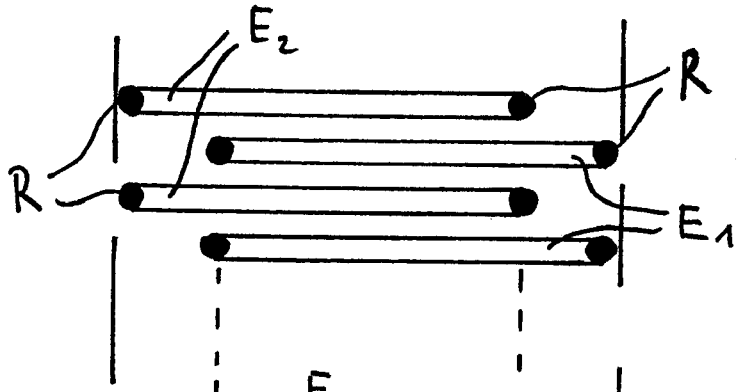
FIGS. 13*a*-13*c* are schematic illustrations of the web laying methods of the FIGS. 7, 9, and 11.
Figure 13B:
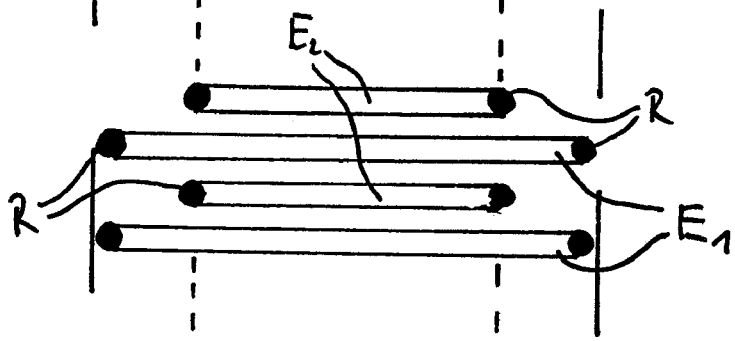

Another embodiment of the laying method is illustrated in FIGS. 9 and 10 as well as the corresponding schematic of FIG. 13*a*. In contrast to the above described method, the zigzag lengths 4 in this laying process have the same length $A_2$ in the individual stacked planes E that is shorter than the inner width $B_K$ of the rectangular can 2 or the rectangular spring plate 12 by approximately the length ΔA.

The two reversal rows R of the zigzag lengths 4 of the new layer $E_2$ are displaced relative to those of the preceding layer, respectively, to the right or to the left by the spacing ΔA. In the layer identified in FIG. 9 by $E_1$ the zigzag lengths 4 or one of the reversing rows R is flush with the right side of the can 2 while in the following plane $E_2$ the left reversing row R is flush with the left side, etc. In this method, when changing from one plane E to the next, the right or the left end position of the pendulous arm 1 is alternatingly inwardly displaced; see also FIG. 13*a*.

Figure 11:
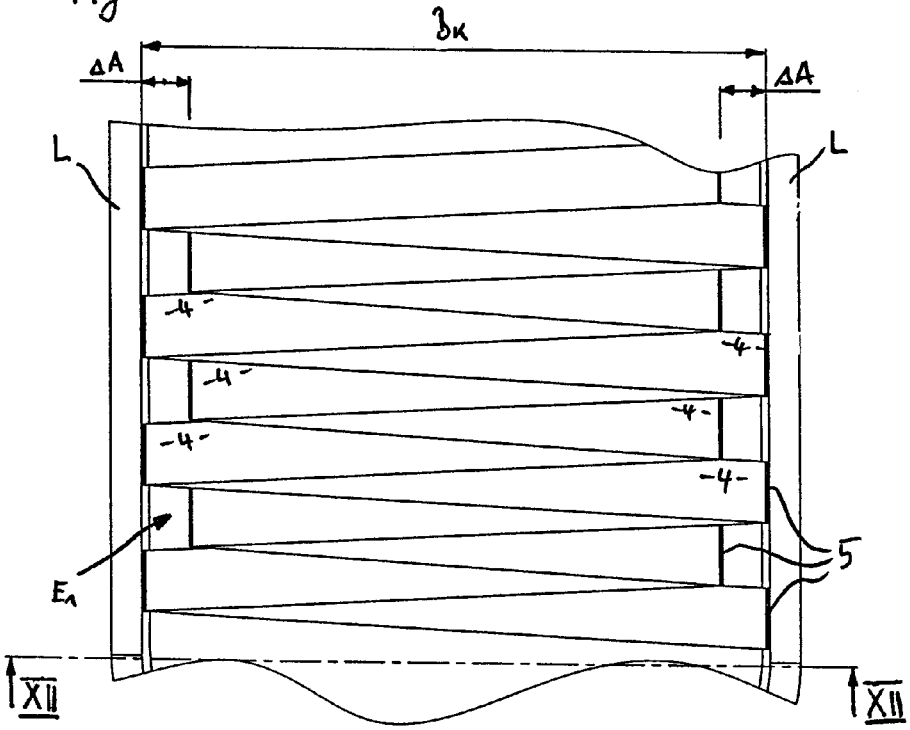
FIG. 11 is a further plan view onto zigzag lengths laid into a can.
Figure 12:
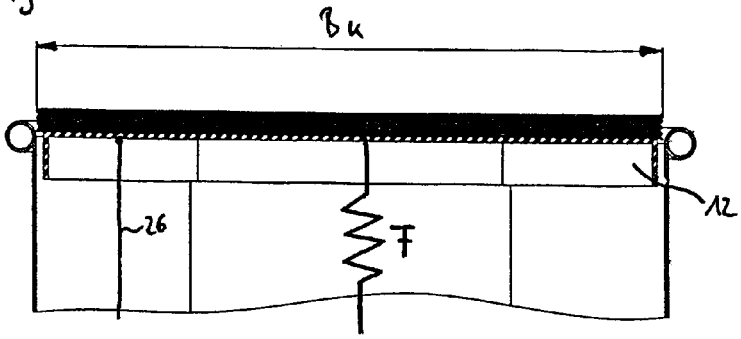
FIG. 12 is a section illustration in accordance with the section line identified at XII-XII in FIG. 11.

A further variant of the laying method according to the invention is illustrated in FIGS. 11 and 12. Here, the reversal points 5 in the individual layers E are not arranged on common reversing rows R but are displaced within a plane E relative to another so that the individual layers E have a serrated outer contour.

The placement of the zigzag lengths 4 is thus realized with continuous variation of the position of the reversal points 5. Viewed in the laying direction, two reversal points 5 that are inwardly displaced by the spacing ΔA follow two reversal points 5 that are flush with a long side L of the can 2. In this way serrated edges of the layers E result where a reversal point 5 that is flush with one side L and a reversal point 5 that is positioned farther inwardly alternate. In the subsequent plane $E_2$ the outwardly positioned flush reversal points 5 are then arranged above the farther inwardly arranged reversal points 5 of the plane $E_1$ positioned underneath, and vice versa. For such a layering, a vertical congruent stacking of folds is prevented.

Figure 13C:
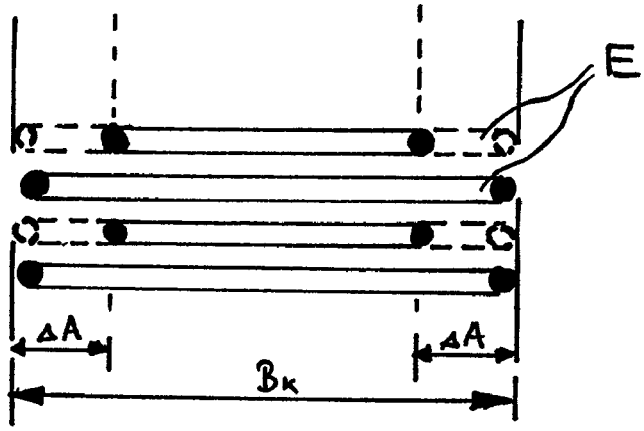

In the corresponding schematic illustration of FIG. 13*c*, the forwardly positioned reversal points 5 are illustrated in solid lines and the reversal points in the same plane that are positioned behind them are illustrated in dashed lines.

The specification incorporates by reference the entire disclosure of German priority document 10 2006 010 069.7 having a filing date of 4 Mar. 2006.

While specific embodiments of the invention have been shown and described in detail to illustrate the inventive principles, it will be understood that the invention may be embodied otherwise without departing from such principles.

What is claimed is:

1. A device for laying continuously supplied web material in zigzag lengths, the device comprising:

a pendulous arm positioned in a supply path of a web material;

a holding-down device pushing down the web material at least in the area of reversal points of zigzag lengths of the web material;

wherein the holding-down device is arranged on the pendulous arm;

wherein the holding-down device has a circular arc-shaped surface that glides across the web material of a last laid zigzag length.

2. The device according to claim 1, wherein the pendulous arm is pivotably supported on a substantially horizontal pendulum axis and wherein the holding-down device is arranged on an end of the pendulous arm facing away from the pendulum axis.

3. The device according to claim 1, wherein the circular arc-shaped surface has a friction-reduced surface.

4. The device according to claim 1, wherein the holding-down device has a substantially ring segment-shaped cross-section.

5. The device according to claim 1, wherein the holding-down device has a rear provided with at least one cutout.

6. The device according to claim 1, wherein the pendulous arm is provided with a web conveyor with which the web material is conveyed from an upper end of the pendulous arm in a direction toward an exit opening in the holding-down device, through which exit opening the web material exits the pendulous arm.

7. The device according to claim 6, wherein the upper end of the pendulous arm is provided with a funnel through which funnel the web material is supplied to the web conveyor.

8. The device according to claim 1, further comprising a drive for the pendulous arm, wherein the drive is a linear motor.

9. The device according to claim 1, comprising a can in which the zigzag lengths of the web material are laid in several stacked layers.

10. The device according to claim 9, wherein the can has a substantially rectangular base area and the zigzag lengths extend between two long sides of the rectangular base area of the can.

11. The device according to claim 10, wherein the can has a spring plate for laying the zigzag lengths, wherein the spring plate is adapted to be lowered against a force of a spring into an interior of the can.

12. The device according to claim 10, wherein the can is movable in a direction of the two long sides of the rectangular base area.

13. The device according to claim 9, further comprising drive means that move the can in a direction of the pendulum axis so that the can passes underneath the pendulous arm.

14. The device according to claim 1, further comprising a substructure in which two cans are movable.

15. A device for laying continuously supplied web material in zigzag lengths, the device comprising:

a pendulous arm positioned in a supply path of a web material;

a holding-down device pushing down the web material at least in the area of reversal points of zigzag lengths of the web material;

wherein the holding-down device is arranged on the pendulous arm;

wherein the pendulous arm is provided with a web conveyor with which the web material is conveyed from an upper end of the pendulous arm in a direction toward an exit opening in the holding-down device, wherein through said exit opening the web material exits the pendulous arm;

wherein the web conveyor comprises at least one leading roller, wherein the holding-down device has a surface that glides across the web material of a last laid zigzag length, wherein the surface of the holding-down device extends to a point below the at least one leading roller, and wherein a first upwardly extending wall of the exit opening of the holding-down device adjoins the surface, and wherein said first upwardly extending wall extends to a level above a bottom side of the at least one leading roller.

16. The device according to claim 15, wherein the first upwardly extending wall and a second upwardly extending wall symmetrically positioned opposite to the first upwardly extending wall together form an upwardly tapering cross-section of the exit opening.

17. The device according to claim 15, further comprising a drive for the pendulous arm, wherein the drive is a linear motor.

18. The device according to claim 15, comprising a can in which the zigzag lengths of the web material are laid in several stacked layers.

19. The device according to claim 18, wherein the can has a substantially rectangular base area and the zigzag lengths extend between two long sides of the rectangular base area of the can.

20. The device according to claim 19, wherein the can has a spring plate for laying the zigzag lengths, wherein the spring plate is adapted to be lowered against a force of a spring into an interior of the can.

21. The device according to claim 19, wherein the can is movable in a direction of the two long sides of the rectangular base area.

22. The device according to claim 18, further comprising drive means that move the can in a direction of the pendulum axis so that the can passes underneath the pendulous arm.

* * * * *